United States Patent [19]

Magid et al.

[11] 4,335,536

[45] Jun. 22, 1982

[54] INFLATABLE THROWING TOY

[76] Inventors: Sidney H. Magid, 4th Fl., No. 10, Alley 5, Lane 12, Sec. 4, Jen Ai Rd.; Wang C. Chung, 3, 11th Fl., No. 311, Sec. 4, Chung-Hsiao E. Rd., both of Taipei, Taiwan

[21] Appl. No.: 199,868

[22] Filed: Oct. 23, 1980

[51] Int. Cl.[3] ..... A63H 27/00

[52] U.S. Cl. ..... 46/74 D; 46/87

[58] Field of Search ..... 46/74 D, 87, 89; 273/424, 425; 9/11 A

[56] References Cited

U.S. PATENT DOCUMENTS

| | | | |
|---|---|---|---|
| Des. 162,022 | 2/1951 | Gilman | 46/87 X |
| 3,130,406 | 4/1964 | Jones-Hinton et al. | 9/11 A |
| 3,180,639 | 4/1965 | Cotler et al. | 46/89 X |
| 4,135,325 | 1/1979 | Lehman | 46/74 D |

FOREIGN PATENT DOCUMENTS

| | | | |
|---|---|---|---|
| 1603662 | 6/1971 | France | 46/74 D |

*Primary Examiner*—Robert Peshock

*Assistant Examiner*—Mickey Yu

*Attorney, Agent, or Firm*—McAulay, Fields, Fisher, Goldstein & Nissen

[57] ABSTRACT

An inflatable throwing toy made of air impervious sheet material comprises an inflatable ring having an inflating valve located thereon the ring being comprised of a bottom and a top section joined at their outer and inner peripheries, and two or more disc sections with at least a first disc section of which being attached to the top section of the inflatable ring and a second disc section being attached to the first disc section of the inflatable ring forming an inflatable enclosure with the first disc section with an inflating valve located on a part of the inflatable enclosure. The inflatable throwing toy may have a cylindrical gusset made of air impervious sheet material joining the top section and the bottom section of the inflatable ring at the inner surfaces thereof and there being a third disc section extending from the bottom section of the inflatable ring. When the third disc section is used, the second disc section is an extension of the top section of the inflatable ring.

15 Claims, 8 Drawing Figures

INFLATABLE THROWING TOY

BACKGROUND OF THE INVENTION

1. Field of the Invention

The present invention relates to an inflatable throwing toy.

2. Brief Description of the Prior Art

In U.S. patent application No. 156,112 filed on June 3, 1980, there is disclosed an inflatable throwing toy made by the same applicants. It is known that the main object of said prior application is to provide a disc shape inflatable throwing toy which can be thrown and caught by the players with controlled floating movement. Although the inflatable toy disclosed in the above mentioned prior application is rather ideal in actual throwing operation, it is found that the control of floating movement can be much improved by simplifying the structure of the toy.

BRIEF SUMMARY OF THE PRESENT INVENTION

It is therefore the main object of the present invention to provide a number of improved modifications of the throwing toy with better controlled floating movement.

Another important object of the present invention is to simplify the structure of the inflatable throwing toy disclosed in the prior application for providing a simpler manufacturing procedure and lowering the cost.

Accordingly, the inflatable throwing toy of the present invention comprises an inflatable ring formed by a top section and a bottom section joined by well known methods at their outer and inner peripheries having an inflating valve located thereon, and two or more disc sections with at least a first disc section being attached to said top section of the inflatable ring and a second disc section being attached to said first disc section of the inflatable ring forming an inflatable enclosure with said first disc section having an inflating means located on a part of the inflatable enclosure. The inflatable throwing toy may have a cylindrical gusset joining the top section and the bottom section of the inflatable ring at the inner periphery thereof and there may be a third disc section extending from the bottom section of the inflatable ring with the second disc section being an extension of the top section of the inflatable ring.

BRIEF DESCRIPTION OF THE DRAWINGS

Those and other objects, advantages and features of the present invention will become apparent from the following detailed description of the preferred embodiments with reference to the accompanying drawings, wherein.

DETAILED DESCRIPTION OF THE PREFERRED EMBODIMENTS

It is to be noted at the beginning that for simplicity the embodiments of the throwing toy of the present invention are shown as sectional views and the corresponding parts in every embodiment are numbered with same numerals.

Figure 1:
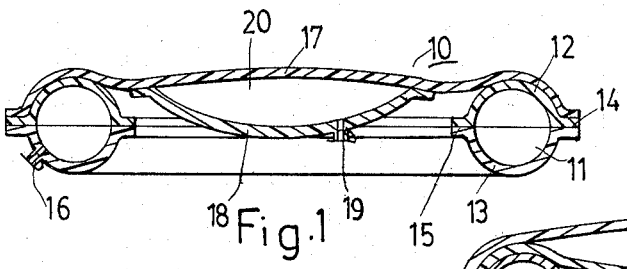
FIG. 1 is a sectional view of a first embodiment of the inflatable throwing toy according to the present invention.

Referring to FIG. 1 which shows a sectional view of a first embodiment of the inflatable throwing toy according to the present invention, the toy 10 comprises an inflatable ring 11 made of inflatable material which comprises a top section 12 and a bottom section 13 sealed by well known methods at their outer periphery 14 and inner periphery 15. The inflatable ring 11 has an inflating valve 16 located thereon. A first disc section 17 is attached to the top section 12 of the inflatable ring 11 and a second disc section 18 is attached to said first disc section 17, with an inflating valve 19 located thereon, forming an inflatable enclosure 20.

Figure 2:
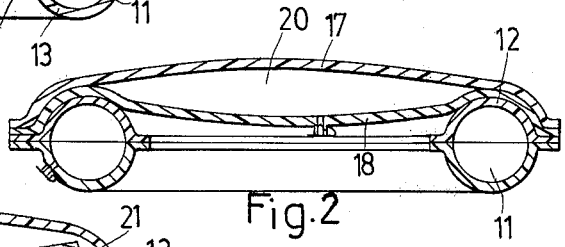
FIG. 2 is a sectional view of a second embodiment of the inflatable throwing toy according to the present invention.

The throwing toy in FIG. 2 has the same structure as that in FIG. 1 except that the second disc section 18 is attached to the top section 12 of the inflatable ring 11 instead of the first disc section 17.

Figure 3:
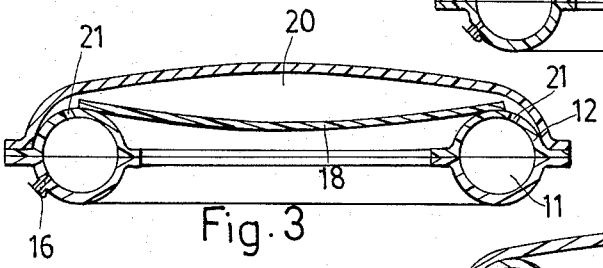
FIG. 3 is a sectional view of a third embodiment of the inflatable throwing toy according to the present invention.

In FIG. 3, the second disc section 18 of the throwing toy is again attached to the top section 12 of the inflatable ring 11 but there is an opening 21 or a plurality of openings 21 provided on the top section 12 for communicating the inflatable enclosure 20 with the inflatable ring 11. Therefore, said openings 21 serve as the inflating means of the inflatable enclosure 20. One can inflate the whole toy through the single inflating valve 16 on the inflatable ring 11. However, the openings 21 can be replaced by a valve member on the first disc section.

Figure 4:
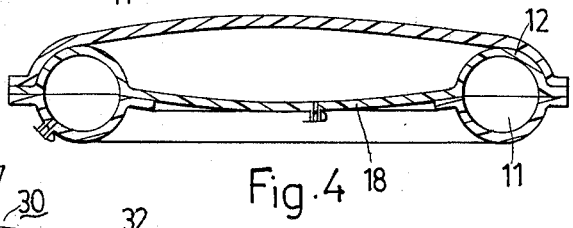
FIG. 4 is a sectional view of a fourth embodiment of the inflatable throwing toy according to the present invention.

In FIG. 4, the throwing toy 10 comprises a second disc section 18 which is an extension of the top section 12 of the inflatable ring 11 instead of attaching thereto.

In the above descriptions for the embodiments of the inflatable throwing toy with reference to FIGS. 1 to 4, two disc sections are employed for forming an inflatable enclosure which can be inflated. It is found under test throwing that the floating movement is nearly perfect because the concave space beneath the second disc section and around by the inflatable ring is filled up with air for supporting the throwing toy. It is believed that due to the concave shape under the toy and convex shape on the top of the toy that the aerodynamic affect is to provide an air flow permitting said toy to be given a controlled movement.

Figure 5:
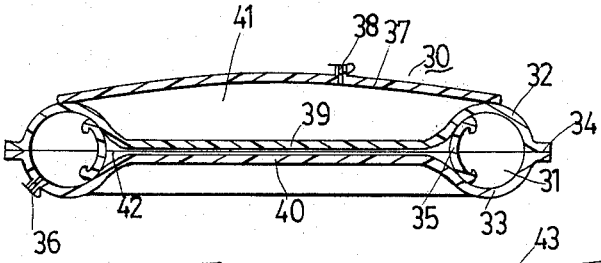
FIG. 5 is a sectional view of a fifth embodiment of the inflatable throwing toy according to the present invention.

Referring to FIG. 5 which shows another embodiment of the inflatable throwing toy according to the present invention, the toy 30 comprises an inflatable ring 31 having a top section 32 and a bottom section 33 joined at the outer periphery 34 with an inflating valve 36 located thereon and also joined by a cylindrical gusset 35 at the inner surfaces thereof. A first disc section 37 is attached to the top section 32 of the inflatable ring 31 with an inflating valve 38 located thereon. A second disc section 39 and a third disc section 40 are the extensions of the top section 32 and bottom section 33 of the inflatable ring 31, respectively, forming an inflatable enclosure 41 and an air tight enclosure 42.

Figure 6:
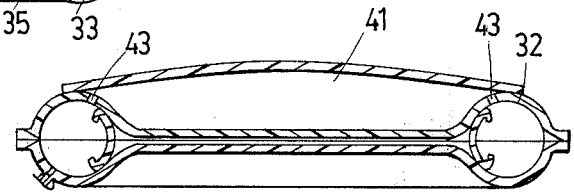
FIG. 6 is a sectional view of a sixth embodiment of the inflatable throwing toy according to the present invention.

The throwing toy in FIG. 6 has a similar structure to that shown in FIG. 5 except that there are a plurality of openings 43 formed on the top section 32 serving as the inflating means for the inflating enclosure 41.

Figure 7:
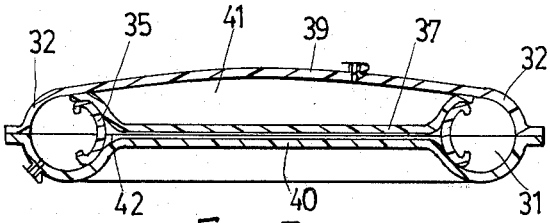
FIG. 7 is a sectional view of a seventh embodiment of the inflatable throwing toy according to the present invention.

Referring to FIG. 7, the toy comprises a first disc section 37 and a third disc section 40 joined by the cylindrical gusset 35. The second disc section 39 which is still an extension of the top section 32 of the inflatable ring 31 is then joined also to the gusset 35. It is seen that the inflatable enclosure 41 is still between the first and second disc sections 37, 39 while the air tight enclosure 42 is between the first disc section 37 and the third disc section 40.

Figure 8:
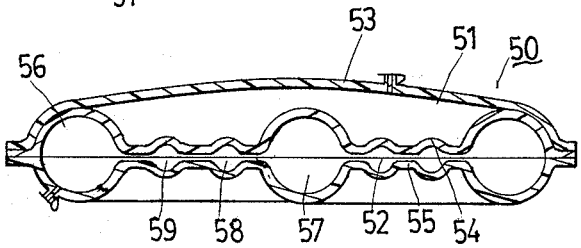
FIG. 8 is a sectional view of a eighth embodiment of the inflatable throwing toy according to the present invention.

Referring to FIG. 8 which shows a particular embodiment of the throwing toy according to the present invention, the toy 50 has no cylindrical gusset and there are two inflatable enclosures 51 and 52 beween first and second disc sections 53, 54 and second and third disc sections 54, 55, respectively. The enclosure 52 actually communicates with the inflatable ring 56 and can be formed into a plurality of concentric inflatable portions 57, 58 and 59 having air passages communicating with each other.

Although the present invention has been described hereinbefore by way of preferred embodiments, it should be understood that various changes or modifications are still possible by those skilled in the art without departing from the spirit and scope of the present invention.

What is claimed is:

1. An inflatable throwing toy of air-impervious sheet material comprising:

an inflatable ring having an inflating valve located thereon, said ring consisting of a top section and a bottom section joined at their outer and inner peripheries;

two or more disc sections with at least a first disc section attached all around its periphery to the top section of said inflatable ring beyond said inner peripheries and a second disc section attached opposite to said first disc section to form an inflatable enclosure therebetween;

and means provided on the inflatable enclosure for inflating said inflatable enclosure;

said top section of said ring and the uppermost disc of said attached discs forming a substantially convex upper surface when said ring and said enclosure are inflated;

said bottom section of said ring and the lowermost disc of said attached discs forming a substantially concave lower surface; said concave and convex surfaces providing an air flow permitting said toy to be given a controlled movement when thrown.

2. The inflatable throwing toy as claimed in claim 1 wherein a cylindrical gusset made of said sheet material joins the top and bottom sections at their inner surfaces to form said inflatable ring, and a third disc section is provided which is an extension of the bottom section of said inflatable ring.

3. The inflatable throwing toy as claimed in claim 2 wherein said second disc section is attached to the top section of said inflatable ring and said first disc section is an extension of the top section, and said cylindrical gusset is attached between the inner surface where said first disc section extends from the top section of said inflatable ring and the inner surface where said third disc section extends from the bottom section of said inflatable ring.

4. The inflatable throwing toy as claimed in claim 1 or 2 wherein said first disc section is attached within the outer periphery of the top section of said inflatable ring.

5. The inflatable throwing toy as claimed in claim 1 or 2 wherein said second disc section is an extension of the top section of said inflatable ring.

6. The inflatable throwing toy as claimed in claim 1, 2 or 3, wherein said inflating means is an inflating valve.

7. The inflatable throwing toy as claimed in claim 1, 2 or 3, wherein said inflating means is an opening in the top section of said inflatable ring so as to provide fluid communication between the inflatable enclosure and said inflatable ring.

8. The inflatable throwing toy of claim 1, having a pair of inflatable enclosures between said first and said second disc sections and said second disc section and a third disc section, one of said inflatable enclosures communicating with said inflatable ring and being formed with a plurality of intercommunicating concentric inflatable portions.

9. The inflatable throwing toy of claim 1 wherein said first and second disc sections are attached all around their peripheries to the outer periphery of the top section of said inflatable ring.

10. The inflatable throwing toy of claim 4 wherein said inflating means is an inflating valve.

11. The inflatable throwing toy of claim 5 wherein said inflating means is an inflating valve.

12. The inflatable throwing toy of claim 4 wherein said inflating means is an opening in the top section of said inflatable ring so as to provide fluid communication between the inflatable enclosure and said inflatable ring.

13. The inflatable throwing toy of claim 5 wherein said inflating means is an opening in the top section of said inflatable ring so as to provide fluid communication between the inflatable enclosure and said inflatable ring.

14. The inflatable throwing toy of claim 1, wherein said top section of said ring together with the uppermost disc of said attached discs form a substantially convex upper surface when said ring and said enclosure are inflated.

15. The inflatable throwing toy of claim 14, wherein said bottom section of said ring together with the lowermost disc of said attached discs form a substantially concave lower surface, and said concave and convex surfaces provide aerodynamic air support when said toy is thrown.

* * * * *